US009162105B2

(12) United States Patent
Huang et al.

(10) Patent No.: US 9,162,105 B2
(45) Date of Patent: Oct. 20, 2015

(54) FITNESS APPARATUS

(71) Applicant: DYACO INTERNATIONAL INC., Taipei (TW)

(72) Inventors: Hsuan-Fu Huang, Hemei Town (TW); Shih-Wei Liu, Hemei Town (TW)

(73) Assignee: DYACO INTERNATIONAL INC., Taipei (TW)

( * ) Notice: Subject to any disclaimer, the term of this patent is extended or adjusted under 35 U.S.C. 154(b) by 432 days.

(21) Appl. No.: 13/804,665

(22) Filed: Mar. 14, 2013

(65) Prior Publication Data

US 2014/0194255 A1 Jul. 10, 2014

(30) Foreign Application Priority Data

Jan. 7, 2013 (TW) ..... 102100453 A

(51) Int. Cl.

| | |
|---|---|
| ***A63B 21/00*** | (2006.01) |
| ***A63B 23/035*** | (2006.01) |
| ***A63B 22/06*** | (2006.01) |
| ***A63B 22/00*** | (2006.01) |
| *A63B 21/005* | (2006.01) |
| *A63B 21/012* | (2006.01) |
| *A63B 21/22* | (2006.01) |
| *A63B 71/00* | (2006.01) |

(52) U.S. Cl.

CPC ..... *A63B 23/03591* (2013.01); *A63B 22/001* (2013.01); *A63B 22/0015* (2013.01); *A63B 22/0664* (2013.01); *A63B 23/03583* (2013.01); *A63B 21/005* (2013.01); *A63B 21/012* (2013.01); *A63B 21/225* (2013.01); *A63B 2022/002* (2013.01); *A63B 2022/0682* (2013.01); *A63B 2071/009* (2013.01)

(58) Field of Classification Search

USPC ..... 482/51, 52, 57, 53, 54, 55, 56

See application file for complete search history.

(56) References Cited

U.S. PATENT DOCUMENTS

| | | | | |
|---|---|---|---|---|
| 5,573,480 | A | 11/1996 | Rodgers, Jr. | |
| 7,682,290 | B2 | 3/2010 | Liao et al. | |
| 7,993,247 | B1 * | 8/2011 | Eschenbach | 482/52 |
| 2004/0097339 | A1 * | 5/2004 | Moon | 482/52 |
| 2013/0244837 | A1 * | 9/2013 | Chen | 482/52 |
| 2015/0087481 | A1 * | 3/2015 | Liu et al. | 482/52 |

FOREIGN PATENT DOCUMENTS

| | | |
|---|---|---|
| TW | M252461 | 12/2004 |

* cited by examiner

*Primary Examiner* — Jerome W Donnelly

(74) *Attorney, Agent, or Firm* — Huffman Law Group, PC

(57) ABSTRACT

A fitness apparatus includes a chassis, two linkages, two handlebars, two cranks and two joint bars. Each of the linkage includes a first linking-up part and second linking-up part transversally. The first linking-up parts are pivotably attached to the cranks for revolution of the cranks relatively to the chassis. Each of the handlebars includes a lower portion pivotably attached to the second linking-up portion, and an upper portion which can be held by the user to move along a closed elliptical trajectory. Each of the joint bars includes a rear and portion pivotably attached between the upper portions and the lower portions, and a front end portion pivotably attached to the chassis. In this way, the user's arms can take exercise effectively along an elliptical trajectory to further prevent the user from suffering sports injury resulting from incorrect posture.

6 Claims, 9 Drawing Sheets

FITNESS APPARATUS

BACKGROUND OF THE INVENTION

1. Field of the Invention

The present invention relates generally to a fitness apparatus and more particularly, to a fitness apparatus capable of moving hands along an elliptical path.

2. Description of the Related Art

As the technology makes progress and the society prospers to enhance the living standard of people, a variety of needs for pastime become relatively high, such as exercise and fitness, sports, travel, and consumer products. Among the needs, the exercise and fitness can be outdoor or indoor. The common indoor fitness apparatuses are miscellaneous, such as elliptical exercise machines, treadmills, flywheel bikes, large weight training machines, or fitness benches. Among them, the elliptical exercise machines can guide users' feet for circulatory exercise along a closed trajectory shaped like an ellipse. Such elliptical exercise is similar to actions of the user's feet while the user is walking and inflicts less impact on the user's joints, no the elliptical exercise machines are very popular among the consumers and have been sold increasingly on the market.

U.S. Pat. No. 5,573,480 disclosed a classical elliptical exercise machine, in which the exercise trajectory is shaped like an ellipse because one end of one support bar is moved along an circular trajectory relatively to a crank mechanism and the other end of the same is limited to a linear trajectory for reciprocating movement.

As disclosed in U.S. Pat. No. 7,682,290, one end of a leg support bar is pivotably attached to an external end of a crank to limit the leg support bar to a circular trajectory and the other end of the same is pivotably attached to a bottom end of a pivoting bar to be limited to an arc-shaped trajectory for forward and backward swing. However, each of the aforesaid prior patents puts emphasis on the elliptical exercise of the user's legs and the user's hands could do nothing but grasp the handlebars to do such a boring to-and-fro swing exercise.

In light of the above, Taiwan Patent No. M252461 disclosed an elliptical exercise machine capable of simulating arm exercise, in which the elliptical exercise machine is formed of a framework and two handlebars connected with one end of the framework. Each of the handlebars includes a bottom end pivotably attached to a front end of one of treadles. Each of the treadles includes a distal end pivotably attached to a periphery of a rotary member, e.g. flywheel, and the two treadles correspond to each other on the rotary member for checkered circulatory exercise along a virtual elliptical path, so in this way, the handlebars can do circulatory movement together therewith. However, the arm swing trajectory generated by the aforesaid elliptical exercise machine is shaped like a circle, so the simulated arm swing is still apparently different from what the user does while walking in practice and is not generally ergonomic. Besides, the rotary member is located at the distal end of the framework, so a longer link is needed to transmit the power to the handlebar located at the front end of the framework. In this way, such elliptical exercise machine is limited in selection of the link and cost of material and its size is relatively larger to make the space be ineffectively utilized.

SUMMARY OF THE INVENTION

The primary objective of the present invention is to provide a fitness apparatus, which allows the user's hands to effectively move along an elliptical path for compliance with actual walking pattern and with ergonomic design.

The foregoing objective of the present invention is attained by the fitness apparatus formed of a chassis, a crank assembly, two leg-exercising assemblies, and two arm-exercising assemblies. The chassis is mounted on a support surface and includes a bottom frame and a framework fixed to a front end of the bottom frame. The crank assembly includes two opposite cranks coaxially pivotably attached to the chassis. Each of the arm-exercising and leg-exercising assemblies is located at left and right sides of the framework. Each of the leg-exercising assemblies is hung to the framework and includes a linkage having a first linking-up part and a second linking-up part transversally. The first linking-up part is pivotably attached to the cranks to enable revolution of the cranks relatively to the chassis. Each of the arm-exercising assemblies includes a handlebar and a joint bar. Each of the handlebars has a lower portion and an upper portion. The lower portions are pivotably attached to the second linking-up portions, respectively. The upper portions can be held by the user to take exercise along a closed elliptical trajectory. Each of the joint bars has a rear end portion and a front end portion. The rear end portions are pivotably attached between the upper portions and the lower portions. The front end portions are pivotably attached to the chassis.

DETAILED DESCRIPTION OF PREFERRED EMBODIMENTS

Structural features and desired effects of the present invention will become more fully understood by reference to a preferred embodiment given hereunder. However, it is to be understood that the embodiment is given by way of illustration only, thus is not limitative of the claim scope of the present invention.

Figure 1:
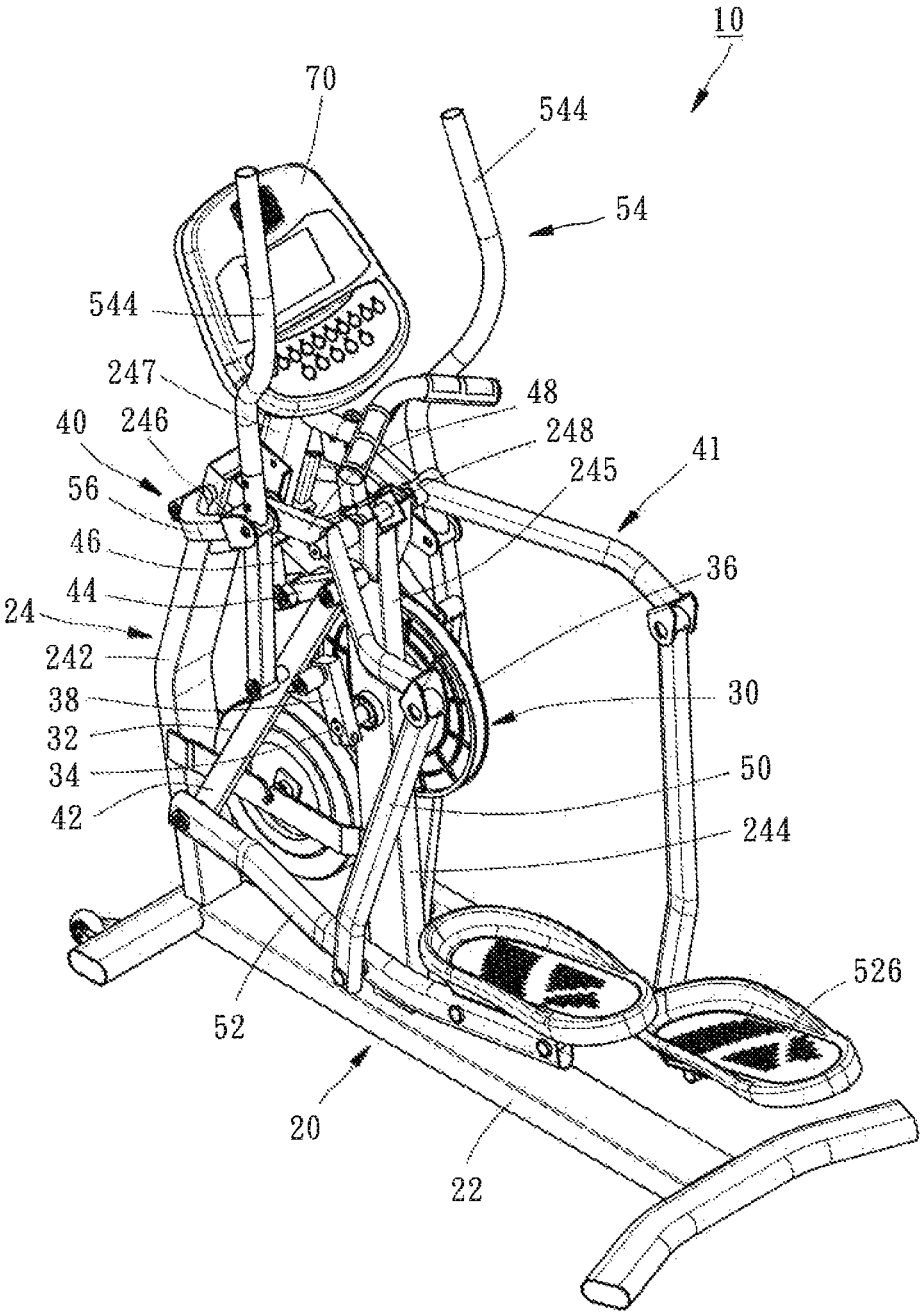
FIG. 1 is a perspective view of a preferred embodiment of the present invention.
Figure 2:
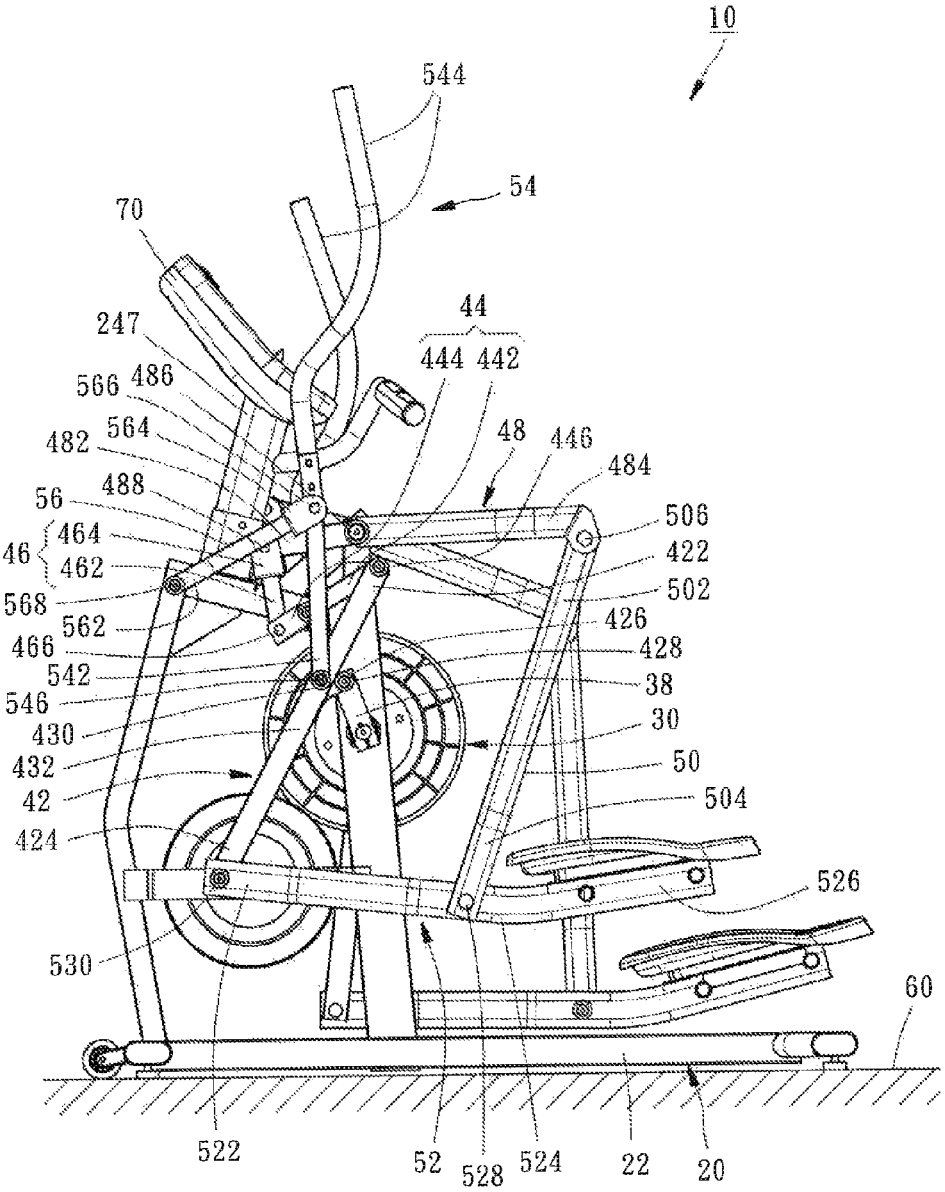
FIG. 2 is a left view of the preferred embodiment of the present invention.
Figure 3:
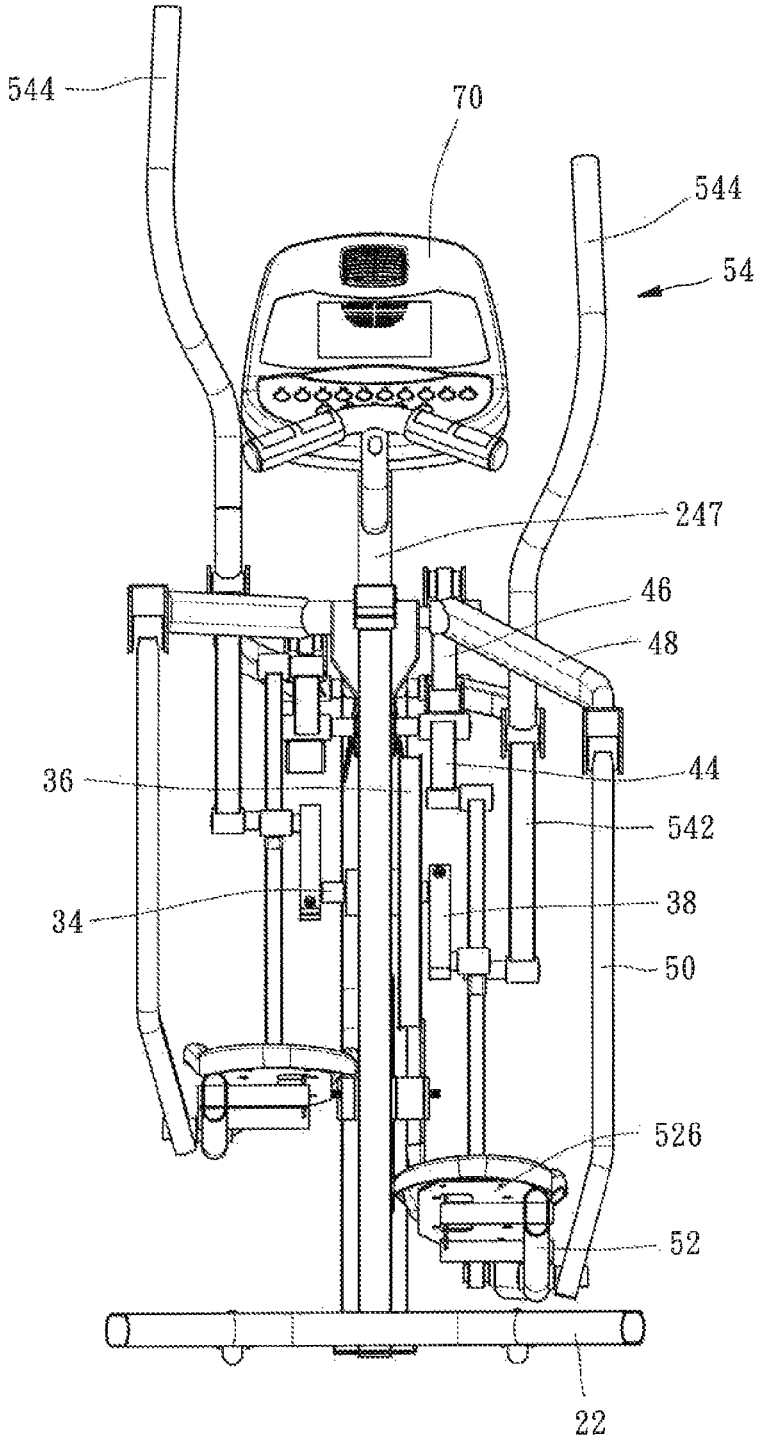
FIG. 3 is a rear view of the preferred embodiment of the present invention.
Figure 4:
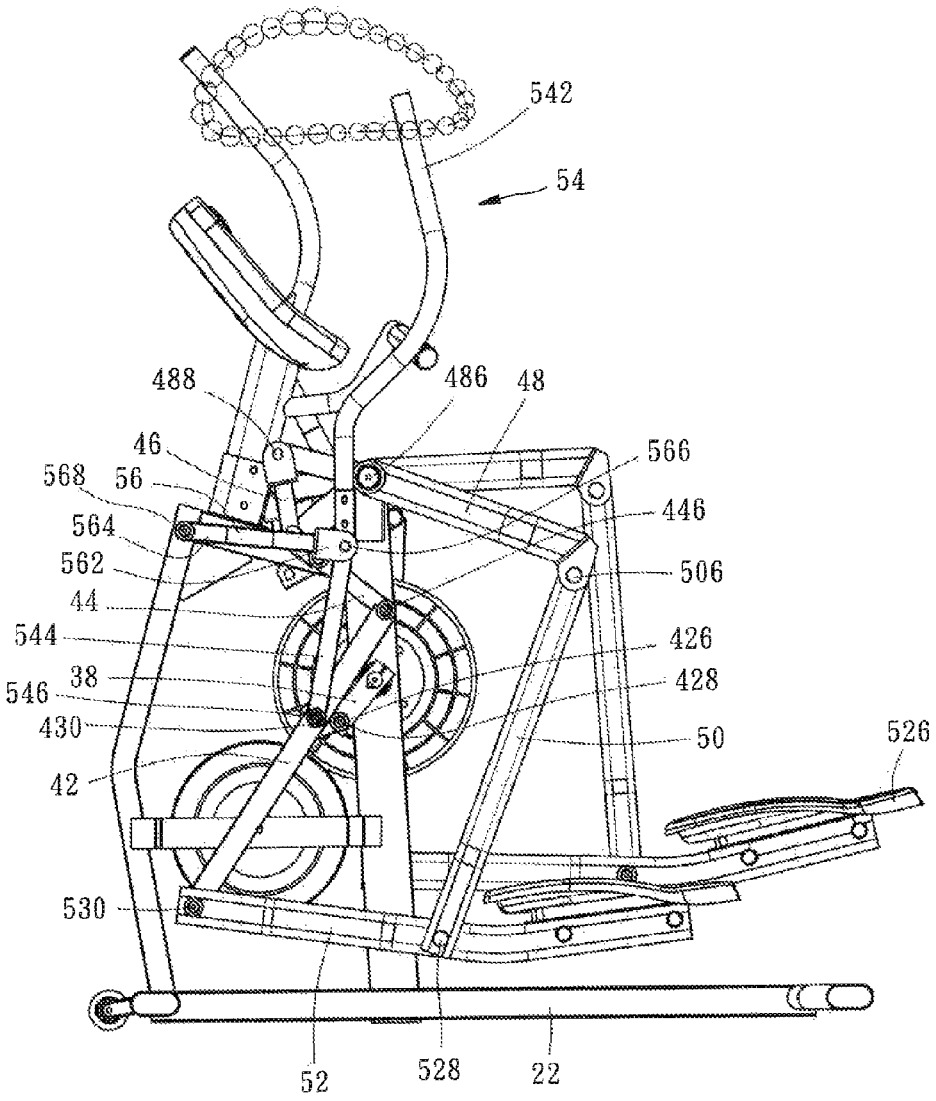
FIG. 4 is a left view of the preferred embodiment of the present invention.
Figure 5:
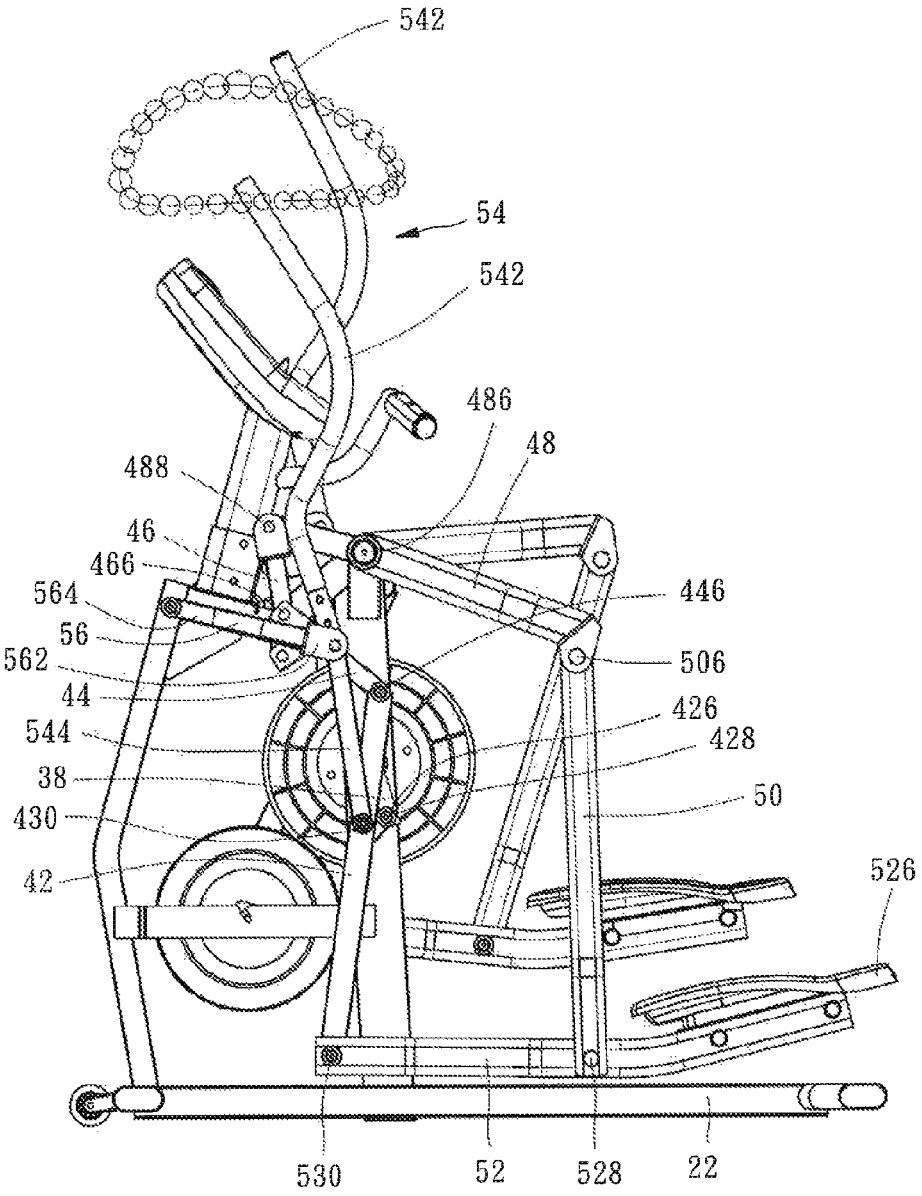
FIGS. 5-9 are similar to FIG. 4, illustrating a variety of operational statuses of the user's hands while the user's feet are located at different treading positions.
Figure 6:
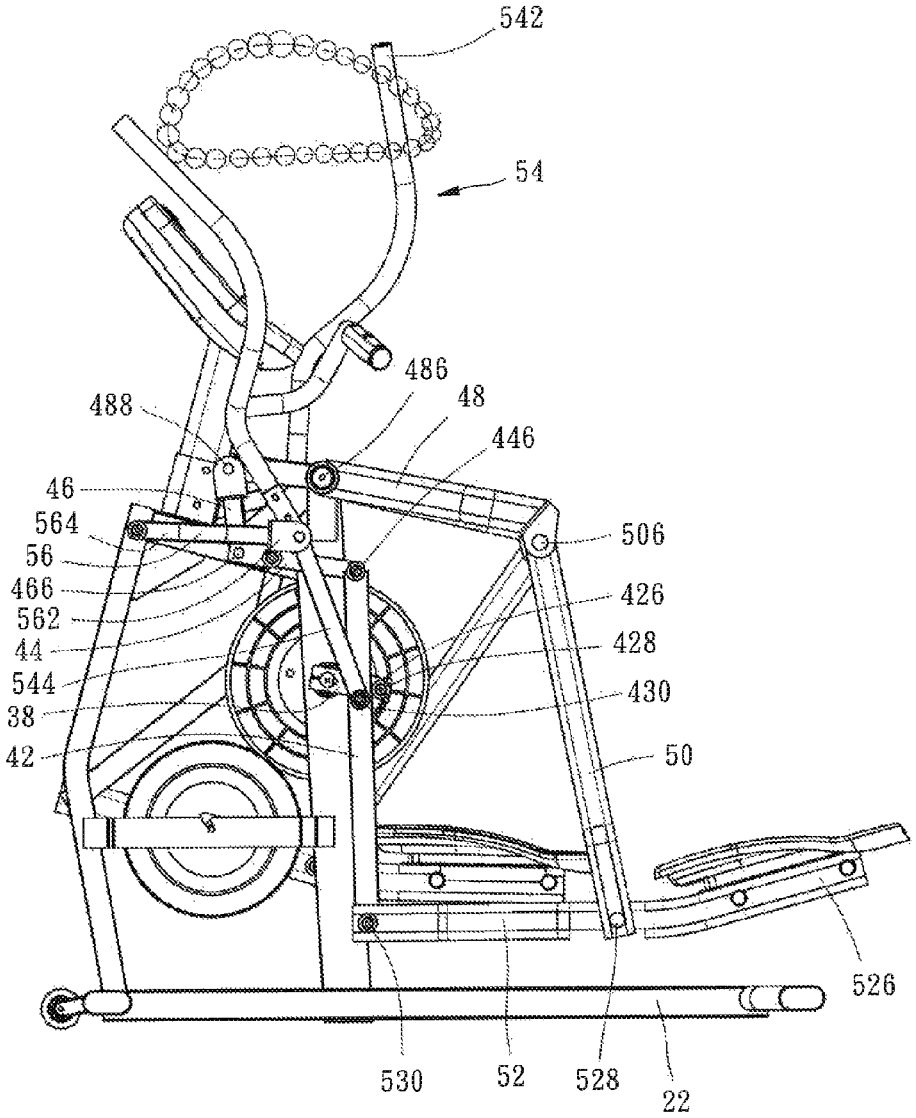
Figure 7:
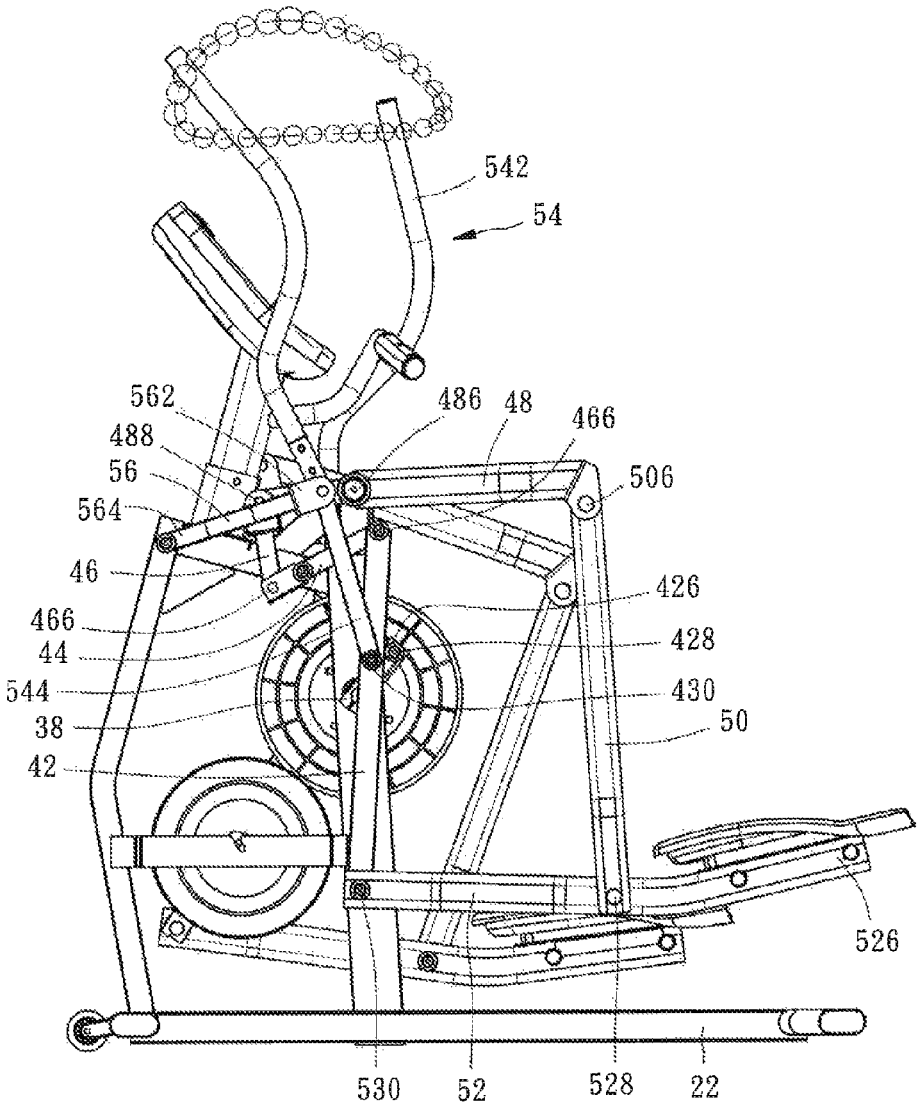
Figure 8:
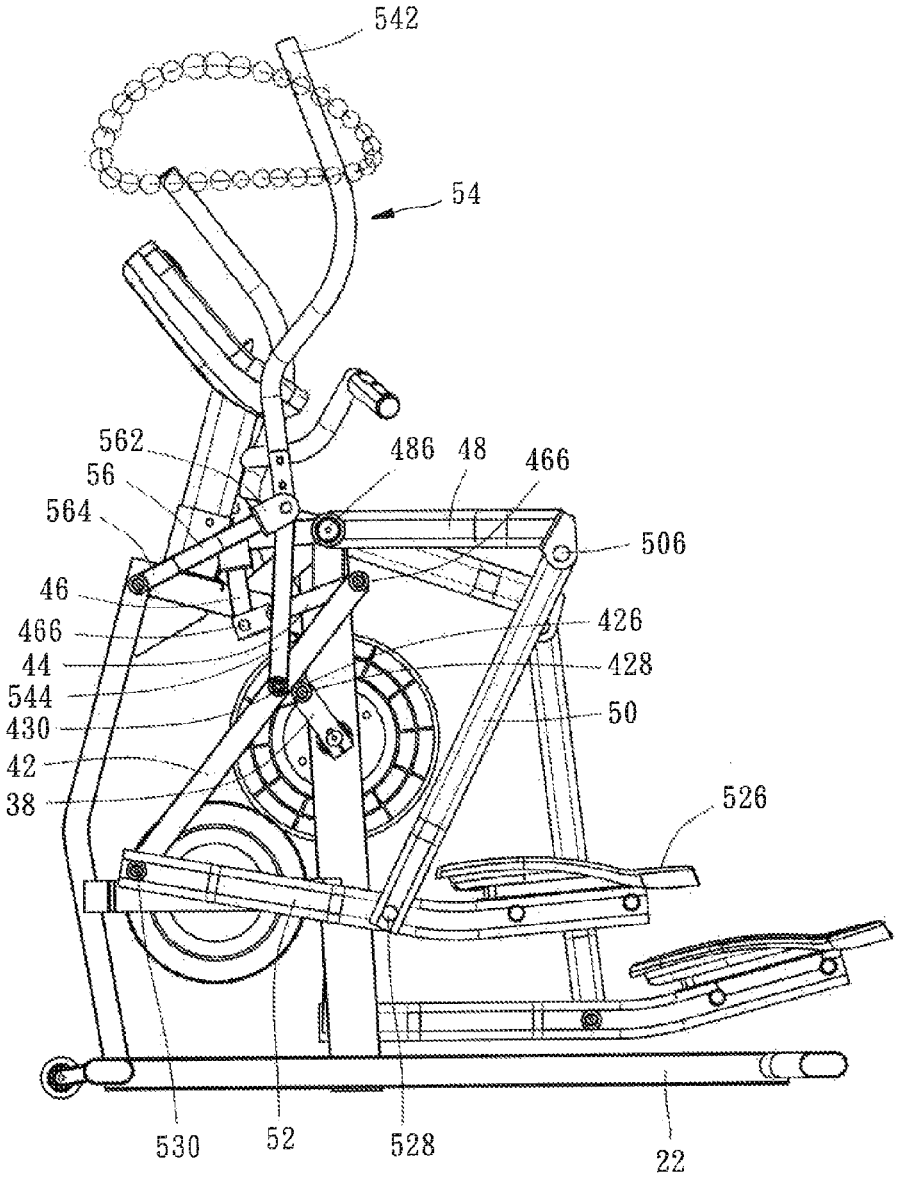
Figure 9:
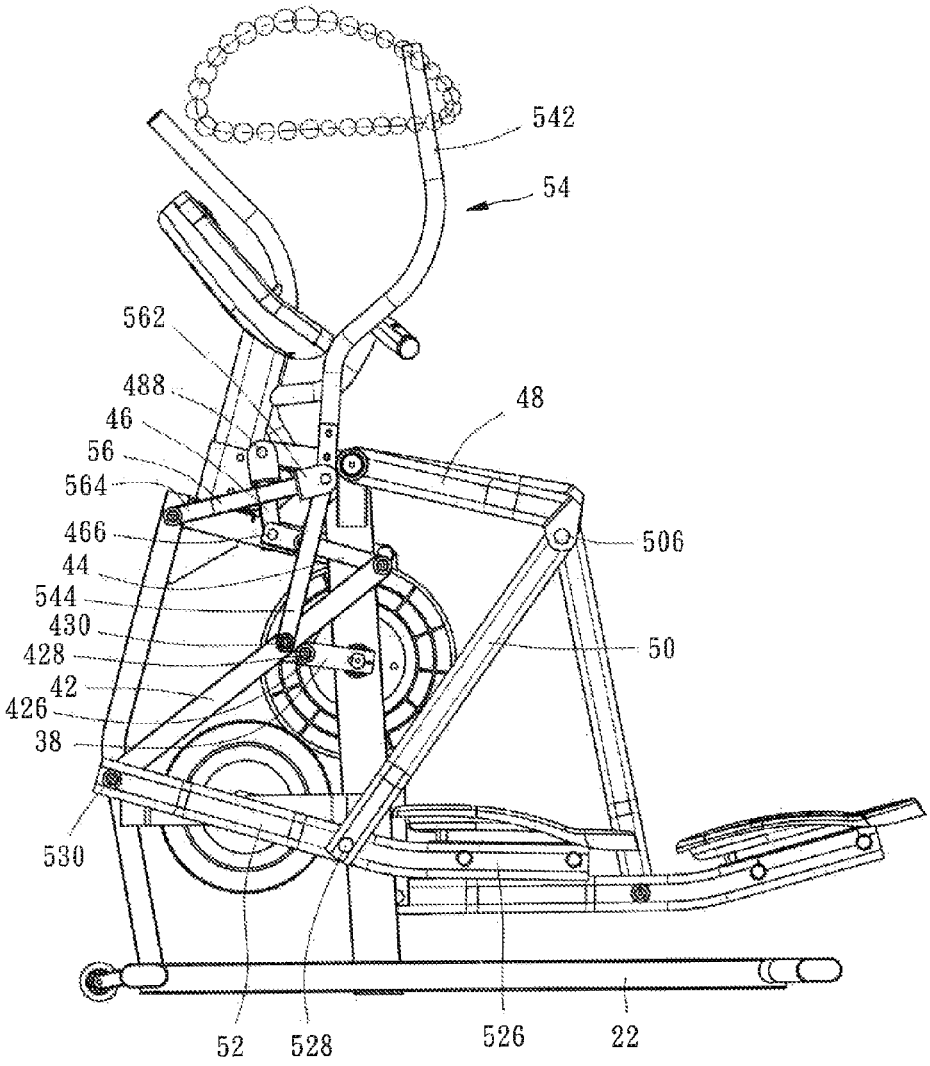

Referring to FIGS. 1-3, a fitness apparatus 10 capable of moving hands along an elliptical path comprises a chassis 20, a crank assembly 30, two leg-exercising assemblies 41, two arm-exercising assemblies 40, and a control panel 70. The detailed descriptions and operations of these elements as well as their interrelations are recited in the respective paragraphs as follows.

The chassis 20 is mounted on a support surface 60 and serves as a foundation for other components. The chassis 20 includes a bottom frame 22 appressed against the support surface 60. A standing framework 24 is fixed to a front end of the bottom frame 22. The framework 24 is formed of a standing part 242 located at a front end thereof, a second standing part 244, a linking part 246 located between the first and second standing parts 242 and 244, an extended part 245 extending toward the linking part 246 from the second standing part 244, a transversal bar 248 located at a top end of the extended part 245, and a fixing part 247 protruding from atop side of the linking part 246. The control panel 70 is mounted to a top end of the fixing part 247.

The crank assembly 30 is formed of a flywheel 32, a crankshaft 34, a first pulley 36, and two cranks 38. The flywheel 32 is mounted between the first and second standing parts 242 and 244 and includes one lateral side coaxially fastened with a second pulley (not shown). The crankshaft 34 is pivotably attached to the second standing part 244 and coaxially fastened with the first pulley 36. The two cranks 38 are vertically fastened with left and right sides of the crankshaft 34, respectively. Besides, a transmission belt (not shown) runs on the first pulley 36 and the second pulley for relative rotation and for inertial revolution of the crank assembly 30 via the flywheel 32.

Each of the leg-exercising assemblies 41 and the arm-exercising assemblies 40 is located at left and right sides of the chassis 20, respectively. Each of the leg-exercising assemblies 41 is formed of a linkage 42, a first link 44, a catch bar 46, a second link 48, a swing arm 50, and a support bar 52. Each of the arm-exercising assemblies 40 is formed of a handlebar 54 and a joint bar 56. Each of the linkages 42 includes a first linking-up part 426 and a second linking-up part 430 transversally and a third linking-up part 422 and a fourth linking-up part 424 longitudinally. In each of the linkages 42, the first and second linking-up parts 426 and 430 are mounted between the third and fourth linking-up parts 422 and 424. Each of the cranks 38 is pivotably attached to one of the first linking-up parts 426 to define a first pivot 428 for revolution relatively to the chassis 20. Each of the handlebar 54 includes a lower portion 542 and an upper portion 544; the lower portion 542 is pivotably attached to the second linking-up part 430 to define an eighth pivot 546; the upper portion 544 can be held by the user for the user to take exercise along a closed elliptical trajectory. Each of the joint bars 56 includes a rear end portion 562 and a front end portion 564; the rear end portion 562 is pivotably attached between the upper portion 544 and the lower portion 542 of the handlebar 54 to define a ninth pivot 566; the front end portion 564 is pivotably attached to an upper end of the first standing part 242 to define a tenth pivot 568. Each of the first links 44 includes a first end portion 442 and a second end portion 444; the first end portion 442 is pivotably attached to the third linking-up part 422 to define a second pivot 446. Each of the catch bars 46 includes a first catch portion 462 and a second catch portion 464; the first catch portion 462 is pivotably attached to the second end portion 444 to define a third pivot 466. Each of the second links 48 includes a first pivotable portion 482, a second pivotable portion 484, and an adaption portion 486; the first pivotable portion 482 is pivotably attached to the second catch portion 464 to define a fourth pivot 488; the adaption portion 486 is pivotably attached to the transversal bar 248, so the second link 48 can work as a lever. Each of the swing arms 50 is located behind the linkage 42 and includes a pivotal portion 502 and a swing part 504; the pivotal portion 502 is pivotably attached to the second pivotable portion 484 to define a firth pivot 506. Each of the support bars 52 extends forward and backward and includes a first connection part 522, a second connection part 524, and a support portion 526; the first connection part 522 is located at a front end of the support bar 52, the support portion 526 is located at a rear end of the support bar 52, and the second connection part 524 is located between the first connection part 522 and the support portion 526; the second connection part 524 is pivotably attached to the swing part 504 to define a sixth pivot 528; the first connection part 522 is pivotably attached to the fourth linking-up part 424 to define a seventh pivot 530. The support portions 526 can support the user's feet, respectively. The framework 24 is fixed to a front end of the bottom frame 22, the crank assembly 30 is mounted in the framework 24, and each of the leg-exercising assemblies 41 and the arm-exercising assemblies 40 is mounted to the left and right sides of the framework 24, so the power transmission efficiency of the crank assembly 30 can be greatly enhanced owing to the shortening of the distance thereof. Besides, all of the crank assembly 30 and the leg-exercising and arm-exercising assemblies 41 and 40 are mounted to a front end of the chassis 20, so while the user intends to operate the fitness apparatus 10, the user can stand on the support portions 526 without overstriding the fitness apparatus 10, so it is more convenient and safer for the user to take exercise on the fitness apparatus 10 of the present invention.

Referring to FIGS. 4-9, the pivoting movement of the cranks 38, the pivoting movement of the handlebars 54 relatively along with the cranks 38, movement of the joint bars 56, the linkages 42, the catch bars 46, and the first and second links 44 and 48, and the swing of the swing arms 50 and the support bars 52 are entangled with one another for synergism. In this way, when the cranks 38 pivot for a positive angle, the lower portion 542 of the handlebar 54 and the support portion 526 of the support bar 52 are located at corresponsive positions of the elliptical trajectory. The first and eighth pivots 428 and 546 present a rotary closed-trajectory movement. The second, third, and fifth pivots 446, 466, and 506 present an up-and-down closed-trajectory movement. The fourth and ninth pivots 488 and 566 present an inclined-angle closed-trajectory movement. The seventh pivot 530 presents a forward-and-backward closed-trajectory movement. The sixth pivot 528 presents an up-and-down forward-backward arc-shaped trajectory movement. All of the pivots mentioned in this paragraph pivot relatively to the tenth pivot 568. In this way, the support portion 526 of the support bar 52 can move along a closed elliptical trajectory, in which break points are arranged much densely. When the user operates the fitness apparatus 10, the user's hands can move along an elliptical trajectory for compliance with the actual walking pattern and the ergonomic design, so the user is not liable to the sports injury, like muscle strain or joint sprain, resulting from incorrect exercise posture. Because the distance between each two adjacent break points is much short, when the user steps on the support portions 526 to move it up to the topmost position and then intends to move it downward, the support portion 526 will neither drop suddenly nor move unsmoothly.

In conclusion, each arm-exercising assembly 40 and each leg-exercising assembly 41 includes the linkage 42, the handlebar 54, the joint bar 56, the first link 44, the catch bar 46, the second link 48, the swing arm 50, and the support bar 52, which are entangled with one another for synergism. In this way, the break points on the elliptical trajectory between the upper portion 544 and the support bar 52 are arranged very densely, so the user can take exercise based on a closed elliptical trajectory for his or her arms and legs for compliance with the actual running pattern. Besides, such exercise pattern is ergonomic, so the user is not liable to sports injury caused by incorrect exercise posture.

What is claimed is:

1. A fitness apparatus comprising:

a chassis for being mounted on a support surface and having a bottom frame, a framework being fixed to a front end of the bottom frame;

a crank assembly mounted in the framework and having two opposite cranks coaxially mounted to the chassis;

two leg-exercising assemblies hung on the framework, each of the leg-exercising assemblies having a linkage, each of the linkage having a first linking-up part and a second linking-up part transversally, the first linking-up parts being pivotably attached to the cranks for revolution of the cranks relatively to the chassis; and two arm-exercising assemblies located at left and right sides of the chassis respectively, each of the two arm-exercising assemblies having a handlebar and a joint bar, each of the handlebars having a lower portion and an upper portion, the lower portions being pivotably attached to the second linking-up parts, the upper portions being for a user to hold to take exercise based on a closed elliptical trajectory, each of the joint bars having a rear end portion and a front end portion, each of the rear end portions being pivotably attached between the upper and lower portions of each handlebar, the front end portions being pivotably attached to the chassis.

2. The fitness apparatus as defined in claim 1, wherein each of the leg-exercising assemblies further comprises a first link, a catch bar, a second link, a swing arm, and a support bar; each of the linkages comprises a third linking-up part and a fourth linking-up part longitudinally, the first link having a first end portion and a second end portion, the first end portion being pivotably attached to the third linking-up part, each of the catch bars having a first catch portion and a second catch portion, the first catch portion being pivotably attached to the second end portion, the second link having a first pivotable portion, a second pivotable portion, and an adaption portion, the first pivotable portion being pivotably attached to the second catch portion, the adaption portion being pivotably attached to the chassis, the swing arm having a pivotal portion and a swing portion, the pivotal portion being pivotably attached to the second pivotable portion, the support bar having a first connection part, a second connection part, and a support portion, the first connection part being pivotably attached to the fourth linking-up part, the second connection part being pivotably attached to the swing portion, the support portions being for supporting the user's feet.

3. The fitness apparatus as defined in claim 2, wherein the swing arms are located behind the linkages; each of the support bars extends forward and backward; the first connection part is located at a front end of the support bar and the support portion is located at a rear end of the support bar; the second connection part is located between the first connection part and the support portion.

4. The fitness apparatus as defined in claim 2, wherein the first and second linking-up parts of each linkage are mounted between the third and fourth linking-up parts.

5. The fitness apparatus as defined in claim 1, wherein the framework comprises a first standing part, a second standing part, and a linking part, the first standing part being located at a front end of the second standing part, the linking part being located between the first and second standing parts.

6. The fitness apparatus as defined in claim 5, wherein the front end portions of the joint bars are pivotably attached to the first standing part.

* * * * *